US006449419B1

(12) United States Patent
Brough et al.

(10) Patent No.: US 6,449,419 B1
(45) Date of Patent: Sep. 10, 2002

(54) OPTICAL VIEWING SYSTEM AND CLAMPING DEVICE THEREFOR

(76) Inventors: Richard Brough, 5645 S. Jefferson, Springfield, MO (US) 65810; Alvin R. Wirthlin, 201 Timberbluff La., Murphy, TX (US) 75094

( * ) Notice: Subject to any disclaimer, the term of this patent is extended or adjusted under 35 U.S.C. 154(b) by 18 days.

(21) Appl. No.: 09/655,433

(22) Filed: Sep. 5, 2000

(51) Int. Cl.[7] ..... G02B 6/00
(52) U.S. Cl. ..... 385/136; 439/799
(58) Field of Search ..... 385/136, 137, 385/62, 81; 439/799

(56) References Cited

U.S. PATENT DOCUMENTS

| | | | |
|---|---|---|---|
| 1,638,230 | A | 8/1927 | Alsaker |
| 2,529,057 | A | 11/1950 | Teffault |
| 2,599,689 | A | 6/1952 | Brelsford |
| 2,614,471 | A | 10/1952 | Markowitz |
| 2,664,797 | A | 1/1954 | Thrasher |
| 2,943,547 | A | 7/1960 | Martin |

(List continued on next page.)

FOREIGN PATENT DOCUMENTS

| | | |
|---|---|---|
| EP | 0192550 | 8/1986 |
| WO | WO99/27318 | 6/1999 |

OTHER PUBLICATIONS

Search Report for PCT/US01/42000 Dated Feb. 12, 2002 in related PCT filing of pending U.S. application.

*Primary Examiner*—Javaid Nasri

(74) *Attorney, Agent, or Firm*—Alvin R. Wirthlin; Akin, Gump, Strauss, Hauer & Feld, LLP

(57) ABSTRACT

An optical viewing assembly and system for transferring image information from one image modifying device to another image modifying device. The optical viewing assembly includes a first image modifying device connected to a second image modifying device through a quick-release clamping arrangement. The clamping arrangement includes first and second clamping portions integrally formed at opposite ends of a hollow sleeve. Each clamping portion has a split collar that is adapted to receive one of the image modifying devices. Each collar includes a pair of clamping legs that are separated from the sleeve by a slot that extends at least part way around a perimeter of the sleeve to thereby permit movement of the clamping legs toward and away from each other. Movement of the clamping legs toward each other reduces a cross dimension of the split collar to thereby clamp one of the image modifying devices therein. Conversely, movement of the clamping legs away from each other increases a cross dimension of the split collar to thereby release a clamped image modifying device. One of the image modifying devices may be in the form of a scope, while another of the image modifying devices may be in the form of a fiber optic viewer. The fiber optic viewer includes a fiber optic bundle that is divided into first and second fiber optic segments. A forward end of the fiber optic bundle is connected to the ocular end of the scope for transferring an image incident at the first image modifying device to a rearward end of each fiber optic segment. One of the segments may be connected to a digital video camera for recording or transmitting the image, and another of the segments may be connected to an eyepiece for simultaneously viewing the image by a user. Other image modifying devices, such as a night vision monocular, may be connected through a further quick release clamp to the opposite end of the scope for viewing images in low light conditions.

23 Claims, 9 Drawing Sheets

U.S. PATENT DOCUMENTS 2,946,255 A 7/1960 Bolay
2,951,292 A 9/1960 Buehler
3,427,103 A 2/1969 McCain
3,464,757 A 9/1969 Schmidt et al.
3,511,159 A 5/1970 Hobbs, Jr.
3,529,882 A 9/1970 Schmidt
3,545,356 A 12/1970 Nielsen
3,602,123 A 8/1971 Shinkle
3,688,665 A 9/1972 Herden
3,709,124 A 1/1973 Hunt
3,785,261 A 1/1974 Ganteaume
3,877,048 A 4/1975 Kellner
3,911,451 A 10/1975 Vockenhuber
4,161,835 A 7/1979 Lough
4,309,095 A 1/1982 Buckley
4,518,221 A 5/1985 Francois
4,524,675 A 6/1985 Durenec et al.
4,822,994 A 4/1989 Johnson et al.
4,835,621 A 5/1989 Black
4,867,071 A * 9/1989 Weber ..... 105/4.1
4,884,137 A 11/1989 Hanson et al.
4,936,190 A 6/1990 Pilcher, II
4,955,812 A 9/1990 Hill
4,961,278 A 10/1990 Johnson et al.
5,020,262 A 6/1991 Pena
5,040,885 A 8/1991 Simms
5,054,225 A 10/1991 Giuffre et al.
5,103,567 A 4/1992 Loving
5,103,713 A 4/1992 Loving
5,130,527 A 7/1992 Gramer et al.
5,140,151 A 8/1992 Weiner et al.
5,157,548 A 10/1992 Monnier et al.
5,200,827 A 4/1993 Hanson et al.
5,272,514 A 12/1993 Dor
5,299,067 A 3/1994 Kutz et al.
5,434,704 A 7/1995 Connors et al.
5,444,507 A 8/1995 Palmer
5,528,418 A 6/1996 Bowman, Jr.
5,834,676 A 11/1998 Elliott
5,836,100 A 11/1998 Stover
5,887,375 A 3/1999 Watson
5,937,562 A 8/1999 Brough
6,094,304 A 7/2000 Wallace et al.

* cited by examiner

OPTICAL VIEWING SYSTEM AND CLAMPING DEVICE THEREFOR

BACKGROUND OF THE INVENTION

1. Field of the Invention

This invention relates to optical devices, and more particularly to an optical assembly and system for transferring image information from one image modifying device to another image modifying device.

2. Description of the Related Art

It is often necessary to either replace or modify optical assemblies, such as firearm day scopes or the like, when lighting or atmospheric conditions change. The replacement of a night vision scope for a day scope often requires dismounting the day scope from the firearm, then mounting and sighting in the night vision scope. This is a time-consuming and labor-intensive task, and is particularly disadvantageous during combat or other life-threatening situations.

A weapon sight sold by ITT as the F7200/F7201 ITT Modular requires a user to interchange a day eyepiece assembly with a night eyepiece assembly in order to use the weapon sight at night. The night eyepiece assembly includes an image intensifier. The conversion of the weapon from day-time use to night-time use and conversely, is time consuming because one eyepiece assembly must be removed before the other eyepiece assembly is mounted. Furthermore, the night eyepiece assembly can cannot be used for any other purpose (e.g., it cannot be used alone as a night vision monocular). Moreover, since the optical parts of an optical assembly are typically maintained in a controlled atmosphere within a housing, each separation affects the reliability and operation of the optical assembly.

Another problem in the prior art is the inability to easily and quickly modify existing optical equipment by connecting together different image modifying devices to thereby increase the usefulness of such equipment.

Thus, there is a need in the art for a device that mounts between two image modifying devices in a relatively quick and easy manner for increasing the effectiveness and usefulness of the image modifying devices.

There is a further need in the art for an optical viewing assembly that can be modified in a relatively quick and easy manner to accommodate a wide variety of needs for different users in varying situations and atmospheric conditions.

SUMMARY OF THE INVENTION

According to the invention, a clamping device for releasably coupling two objects together includes a hollow sleeve having a first end and a second end, a first clamping portion integrally connected to the hollow sleeve first end, and a second clamping portion integrally connected to the hollow sleeve second end. Each of the first and second clamping portions have a split collar that is adapted to receive one of the objects. Each collar includes a pair of clamping legs that are separated from the sleeve by a slot that extends at least part way around a perimeter of the sleeve to thereby permit movement of the clamping legs toward and away from each other. Movement of the clamping legs toward each other reduces a cross dimension of the split collar to thereby clamp one of the objects therein. Conversely, movement of the clamping legs away from each other increases a cross dimension of the split collar to thereby release a clamped object.

According to a further embodiment of the invention, an optical viewing assembly comprises a first image modifying device having a forward end and a rearward end, a second image modifying device connected to the first image modifying device, and a third image modifying device connected to the second image modifying device. The second image modifying device includes a fiber optic viewer. The fiber optic viewer comprises a fiber optic bundle that is divided into first and second fiber optic segments. A forward end of the fiber optic bundle is connected to the rearward end of the first image modifying device for transmitting an image incident at the first image modifying device to a rearward end of each fiber optic segment. The third image modifying device is connected to a rearward end of one of the fiber optic segments for transforming the incident image to electrical signals.

BRIEF DESCRIPTION OF THE DRAWINGS

The preferred embodiments of the present invention will hereinafter be described in conjunction with the appended drawings, wherein like designations denote like elements, and wherein.

It is noted that the drawings are intended to depict only typical embodiments of the invention, and therefore should not be considered as limiting the scope thereof. The invention will now be described in greater detail with reference to the drawings.

DETAILED DESCRIPTION OF THE PREFERRED EMBODIMENTS

Figure 1:
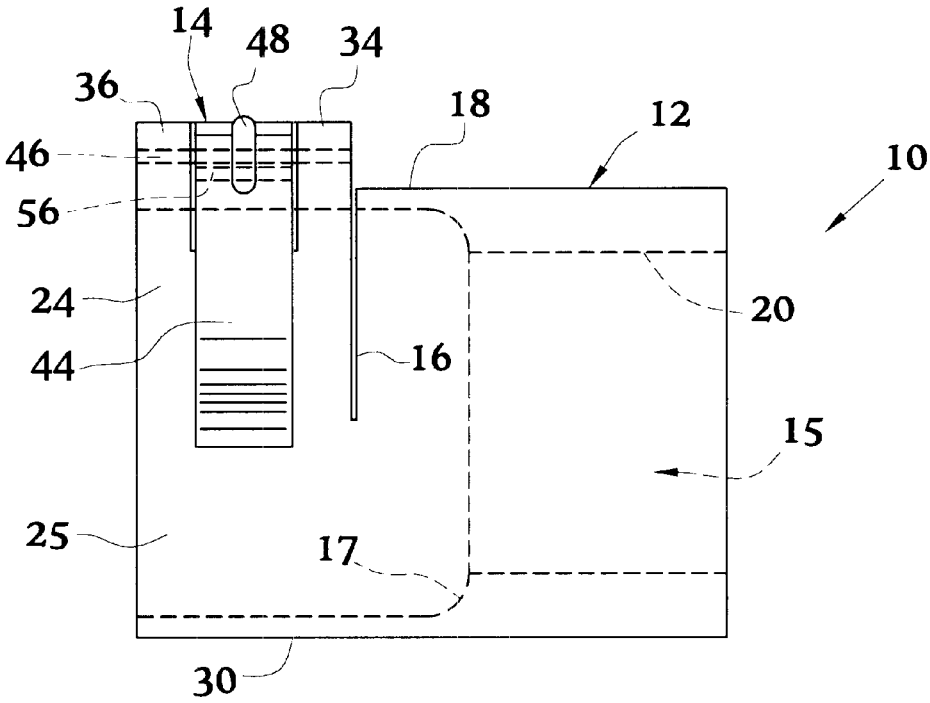
FIG. 1 is a side elevational view of a clamping device according to the present invention.
Figure 2:
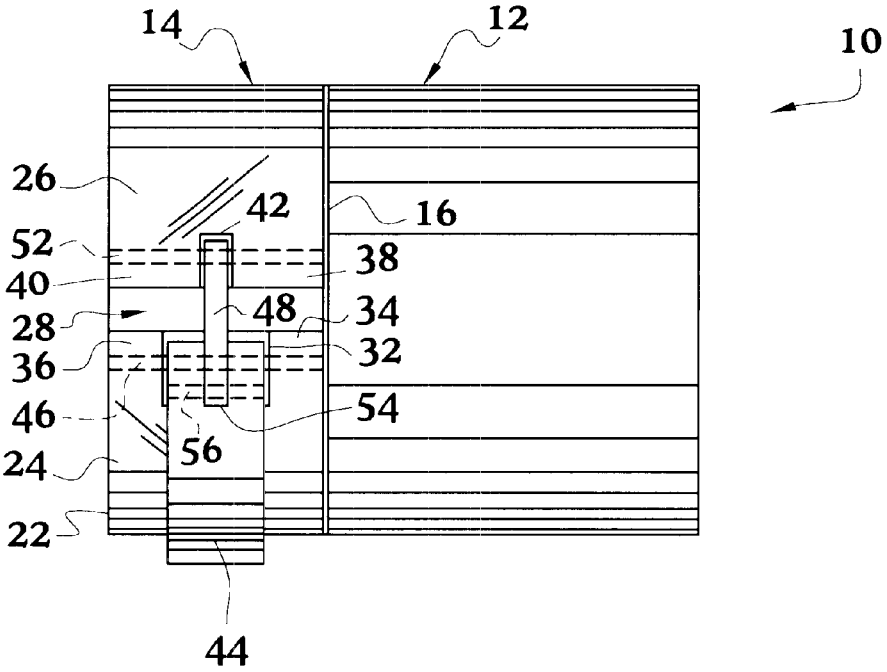
FIG. 2 is a top plan view of the clamping device of FIG. 1.

Referring now to the drawings, and to FIGS. 1 and 2 in particular, an exemplary embodiment of a clamping device 10 according to the invention is illustrated. The clamping device 10 includes a sleeve portion 12 that is preferably integrally formed with a clamping portion 14. As shown, the sleeve portion 12 is of generally hollow cylindrical configuration and is partially separated from the clamping portion 14 by a circumferentially extending slot 16 that extends through a thickness of the sleeve portion 12 from an outer surface 18 to an inner surface 20 thereof. Preferably, the slot extends approximately half-way around the circumference of the sleeve portion 12. A central bore 15 (shown in hidden line in FIG. 1) extends through the sleeve portion 12 and clamping portion 14. A raised shoulder 17 is formed in the bore 15 and may be used to stop or prevent movement of an elastomeric bushing (not shown) or the like further into the bore 15. The clamping device 10 is preferably constructed of metal, such as anodized aluminum, but may alternatively be constructed of plastics, composites, and other materials that exhibit high strength, especially in the clamping portion 14. The sleeve portion 12 may form part of a housing of an image modifying device or may be permanently connected thereto.

The term "image modifying device" as used herein refers to any device or assembly that alters an image as perceived by the naked eye, e.g. that changes the apparent brightness, intensity, magnification, color, and/or field of view of an image, and/or that electronically modifies an image through recording, transmitting, encoding, and so on. Such image modifying devices may include, but are not limited to, filters, one or more lenses, rifle or gun scopes, spotting scopes, telescopes, laser rangefinders, mortar sights, anti-tank sights, bow sights, surveying transits, night vision monoculars including image intensifying and thermal imaging devices, infrared cameras, image pickup devices, gyro-stabilized and digitally stabilized optics, binoculars, film-type cameras, devices that transform an image into electrical signals such as still or video cameras of the digital or analog type, image recording devices, image pick-up heads, flying spot scanners, and so on.

Figure 3:
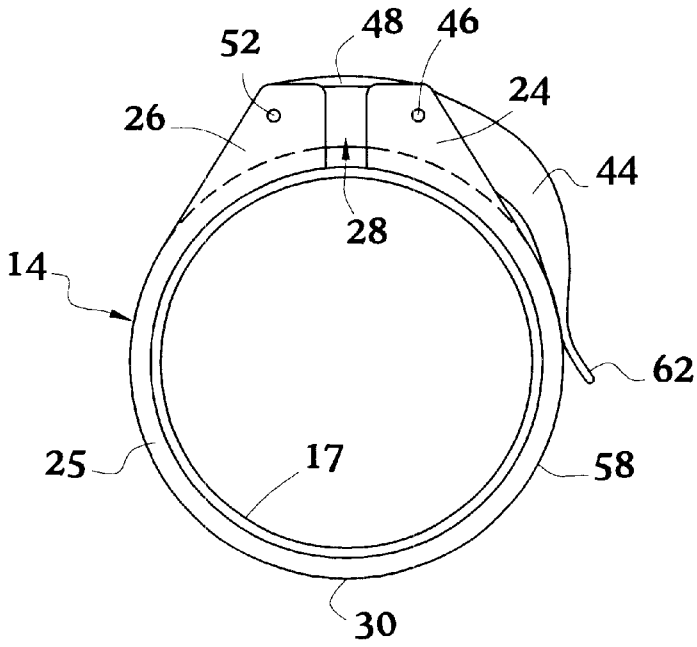
FIG. 3 is a front elevational view of the clamping device in a locked or closed position.
Figure 4:
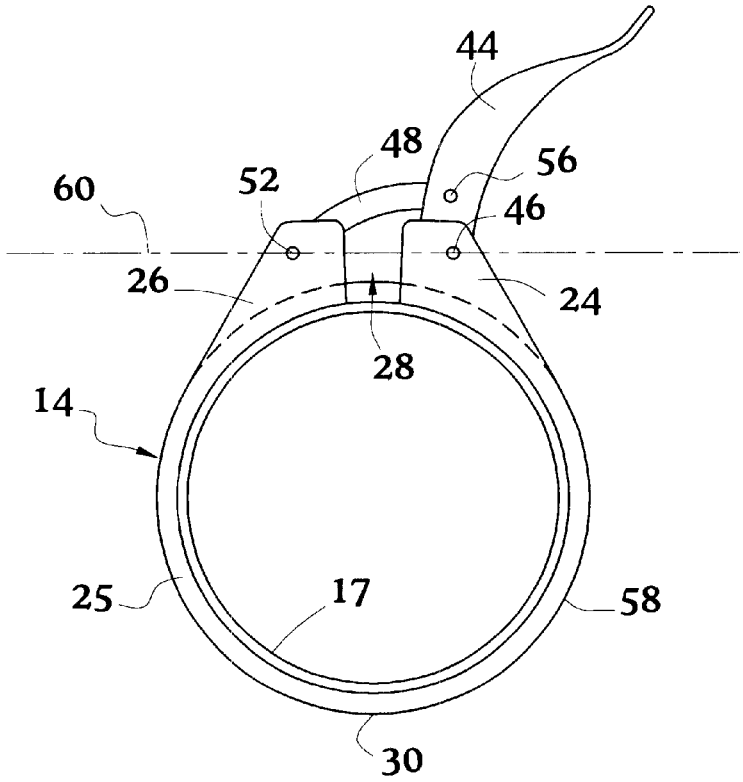
FIG. 4 is a front elevational view of the clamping device in an unlocked or open position.

With further reference to FIGS. 3 and 4, the clamping portion 14 includes a split collar 22 that has a tubular section 25 and is preferably integrally formed with the sleeve portion 12 under the slot 16. A pair of spaced clamping legs 24, 26 extend outwardly from the tubular section 25 and are separated from the sleeve 12 by the circumferential slot 16. A space 28 between the legs accommodates relative leg movement between clamped and unclamped positions, as will be described in greater detail below. The legs 24, 26 preferably have a height as measured from the bottom 30 of the clamping portion 14 that is greater than the diameter of the sleeve portion 12. An outer free end of the leg 24 is divided into a pair of spaced shoulders 34, 36 by a ramped channel 32 that extends generally transverse to a central axis of the tubular section 25. Likewise, an outer free end of the leg 26 is divided into a pair of spaced shoulders 38, 40 by a groove 42 that is in alignment with the ramped channel 32. A locking lever 44 is pivotally connected to the leg 24 in the ramped channel 32 between the shoulders 34, 36. In a preferred arrangement, a roll pin 46 extends through bores formed in the shoulders 34, 36 and a bore formed in the locking lever 44.

The diameter of the bores in the shoulders are preferably smaller than the diameter of the bore in the locking lever so that the roll pin 46 is frictionally held in the shoulders with the locking lever pivoting about the roll pin. A link arm 48 has a first end that is pivotally connected to the leg 26 in the groove 42 between the shoulders 38, 40 and a second end that is pivotally connected to the lever arm 44 in a groove 54 formed in the lever arm. In a preferred arrangement, the link arm first end pivots about a second roll pin 52 that extends through and frictionally engages bores formed in the shoulders 38, 40. The link arm second end pivots about a third roll pin 56 that extends through and frictionally engages bores formed in the locking lever 44.

As best shown in FIG. 4, the first and second ends of the link arm 48 curve generally downwardly toward their respective pivot pins. Preferably, the roll pins 46, 52 and 56 are constructed of hardened steel and the link arm 48 is constructed of 1045 carbon steel that has been heat-treated to form resilient or spring-like properties. The roll pins and link arm may include a manganese phosphate coating or other coating. It is to be understood that other materials may be used for the roll pins and link arm. In an alternative embodiment, the roll pins may be replaced with solid pins or other means for permitting relative pivoting movement between the clamping legs, locking lever and link arm.

In use, the lever arm 44 is initially in an open position (FIG. 4) prior to mounting the clamping device 10 to an image modifying device. An elastomeric bushing (not shown) may be positioned in the bore 15 at the clamping portion 14 or mounted on the image modifying device prior to installing the clamping device 10 on the image modifying device. Once the image modifying device is received in the clamping portion 14, the locking lever 44 is rotated clockwise as viewed in FIG. 4. Rotation of the locking lever in this manner causes the link arm 48 to pull the leg 26 toward the leg 24 and reduce the size of the gap 28 and the diameter of the tube section 25. As the pivot pin 56 passes an imaginary line 60 extending through the pivot pins 46 and 52 to an over-center position, the lever arm 44 snaps toward an outer surface 58 of the tubular section 25. In this position, the legs 24, 26 are locked in a clamped or closed position with the tubular section 25 at the reduced diameter to thereby firmly hold the image modifying device therein. The size of the reduced diameter and the bushing can be adjusted to accommodate a variety of different image modifying devices. The shape of the link arm 44 and its resilient-like properties contribute to a more consistent clamping force despite variations in tolerance for the clamping device 10, the bushing and the image modifying device. An outer free end of the locking lever 44 is flared at 62 to facilitate grasping by a user when it is desirous to return the clamping portion 14 to the released position.

Figure 5:
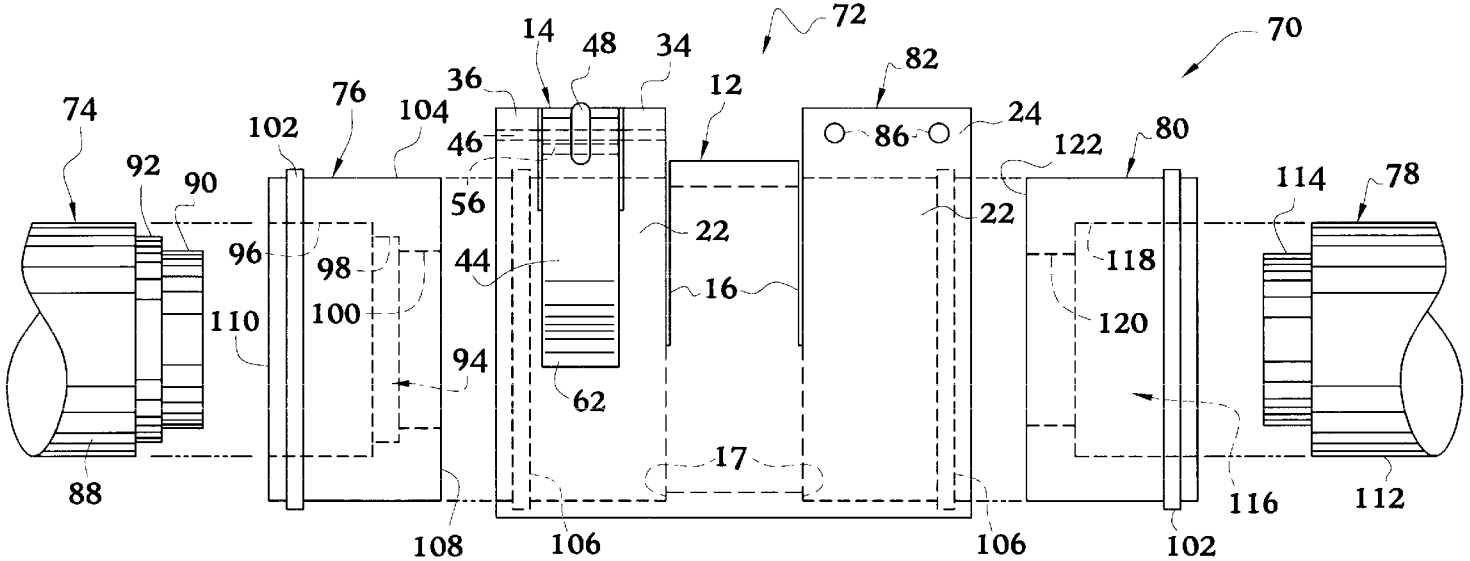
FIG. 5 is a side elevational view of an optical viewing assembly incorporating a clamping device according to a second embodiment of the invention.
Figure 7:
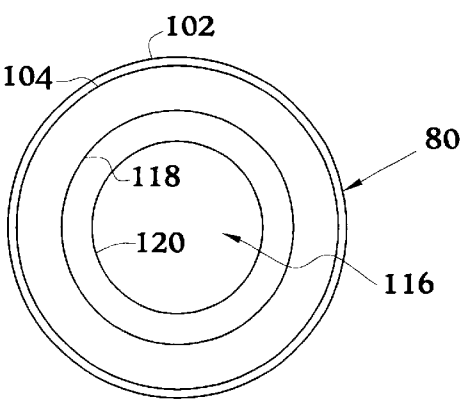
FIG. 7 is a rear plan view of a second bushing for installation between the claming device and a second image modifying device.
Figure 6:
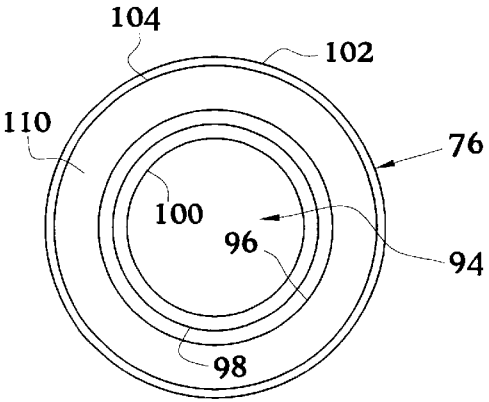
FIG. 6 is a rear plan view of a first bushing for installation between the clamping device and an image modifying device according to the invention.

With reference now to FIGS. 5–7, an optical viewing assembly 70 incorporating a clamping device 72 according to a second embodiment of the invention is illustrated, wherein like parts in the previous embodiment are represented by like numerals. The optical viewing assembly 70 includes a first image modifying device 74 with a first bushing 76 for connection to a first clamping portion 14 of the clamping device 72, and a second image modifying device 78 with a second bushing 80 for connection to a second clamping portion 82 of the clamping device 72. The second clamping portion 82 is similar in construction to the first clamping portion 14 (previously described) with the exception that the locking lever 44, roll pins 46, 52 and 56, channel 42, grooves 42 and 54, and link arm 48 are replaced with fasteners 86, preferably in the form of machine screws, that extend through the clamping leg 24 and thread into the clamping leg 26 (not shown in FIG. 5). With the second image modifying device 78 and bushing 80 installed within the split collar 22 of the second clamping portion 82, the fasteners 86 can be turned in one direction to draw the clamping legs together and tighten the split collar 22 around the bushing 80 and image modifying device 78. In this manner, the clamping device 72 can be more permanently installed on the image modifying device 78, although it is possible to remove the clamping device 72 by turning the fasteners 86 in the opposite direction.

The first image modifying device 74 may include a housing 88 with a lens assembly 90 that is adjustable with respect to the housing 88 through rotation of a focus adjusting ring 92. As used throughout the specification, the term "lens assembly" may refer to one or more lenses. The first bushing 76 is preferably constructed of an elastomeric material, such as polyurethane, rubber, or the like. A bore 94 is formed in the first bushing 76 and is preferably shaped to complement the shape of the first image modifying device 74. As shown, the bore 94 includes a first inner surface 96 sized and shaped to receive an end of the housing 88, a second inner surface 98 sized and shaped to receive the adjusting ring 92, and a third inner surface 100 sized and shaped to receive the lens assembly 90. An outer ring 102 is formed on an outer surface 104 of the bushing 76. When the first bushing 76 is installed in the first clamping portion 14, the outer ring 102 fits within an inner groove 106 (shown in hidden line in FIG. 5) with a forward edge 108 of the bushing 76 abutting the shoulder 17. In this manner, the bushing 76 is secured against slipping further forward or rearward in the clamping device 72. This feature is especially advantageous when the clamping device 72 is mounted, for example, to the scope of a firearm and is therefore subject to kick-back and other forces during use and/or transportation of the firearm. The outer ring 102 in cooperation with the inner groove 106 also assure that the bushing 76 will remain in the first clamping portion 14 when the clamping device 72 and image modifying device 74 are separated. The bushing 76 may be removed by grasping either the rearward edge 110 or forward edge 108 and then deforming or collapsing the bushing until the outer ring 102 is free of the inner groove 106.

It is to be understood that the terms of orientation and location as used throughout the specification, such as forward and rearward, together with their respective derivatives, refer to relative rather than absolute orientations and/or positions.

The second image modifying device 78 may include a housing 112 and a fixed lens assembly 114. The second bushing 80 is also preferably constructed of an elastomeric material and includes a bore 116 with a first surface 118 that is sized and shaped to receive the housing 112 and a second surface 120 that is sized and shaped to receive the lens assembly 114. As with the first bushing 76, an outer ring 102 is formed on an outer surface 104 of the second bushing 80. When the second bushing 80 is installed in the second clamping portion 82, the outer ring 102 fits within an inner groove 106 (shown in hidden line in FIG. 5) with a rearward edge 122 of the second bushing 80 abutting the shoulder 17. In this manner, the second bushing 80 is secured against slipping further forward or rearward in the clamping device 72 and may be removed in the same manner, as previously described with respect to the first bushing 76.

Figure 8:
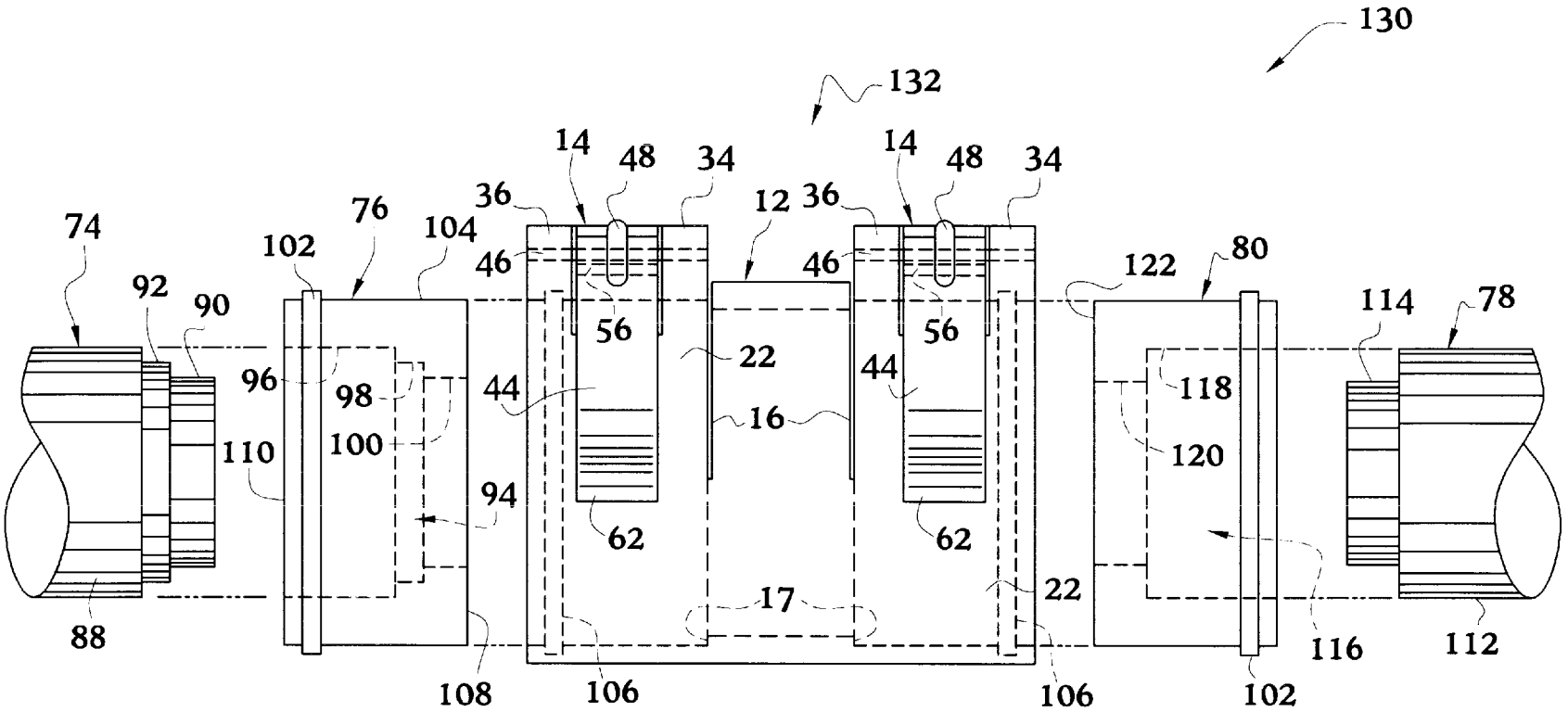
FIG. 8 is a side elevational view of an optical viewing assembly incorporating a clamping device according to a third embodiment of the invention.

With reference now to FIG. 8, an optical viewing assembly 130 incorporating a clamping device 132 according to a third embodiment of the invention is illustrated, wherein like parts in the previous embodiments are represented by like numerals. The clamping device 132 includes two identical clamping portions 14 that are separated by the sleeve portion 12 for connecting a first image modifying device 74 to a second image modifying device 78 together with their respective bushings 76 and 80, as previously described. The clamping portions 14 enable the relatively quick connection of two image modifying devices that are optically aligned, as well as their quick disconnection. Thus, where it is desirous, for example, to couple a night vision monocular to either the ocular or objective lens of a daylight scope, the clamping device 30 ensures that the scopes will be optically aligned and quickly connected together. Although the locking levers 44 are shown on the same side of the clamping device 30, one of the locking levers 44 may be located on the opposite side.

Figure 9:
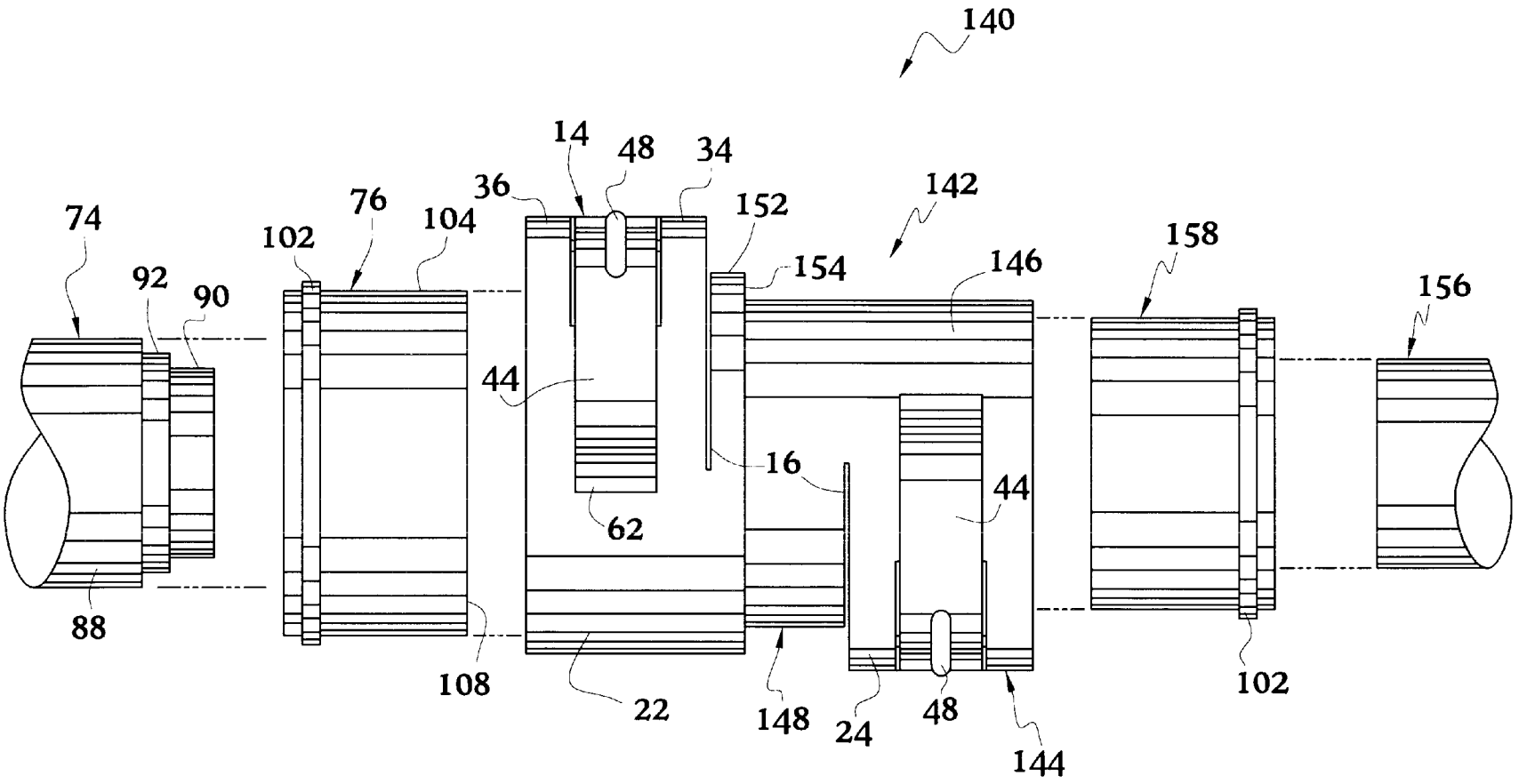
FIG. 9 is a side elevational view of an optical viewing assembly incorporating a clamping device according to a fourth embodiment of the invention.

With reference now to FIG. 9, an optical viewing assembly 140 incorporating a clamping device 142 according to a fourth embodiment of the invention is illustrated, wherein like parts in the previous embodiments are represented by like numerals. The clamping device 142 includes a first clamping portion 14 that is offset from a second clamping portion 144. Preferably, the second clamping portion 144 is similar in construction to the first clamping portion 14. As shown, the split collar 146 of the clamping portion 144 is smaller in diameter than the split collar 22 of the clamping portion 14. The locking lever 44 and clamping legs 24, 26 of the clamping portion 144 extend in an opposite direction from the locking lever 44 and clamping legs 24, 26 of the clamping portion 14. A sleeve 148 extends between the clamping portions 14, 144 and is preferably integrally formed therewith. The sleeve 148 has a step or shoulder 154 that extends to a larger diameter generally cylindrical portion 152 adjacent the first clamping portion 14.

The first and second clamping portions 14, 144 connect a first image modifying device 74 with its respective bushing 76 to a second image modifying device 156 with its respective bushing 158. The second image modifying device 156 and the second bushing 158 are of smaller diameter than the first image modifying device 74 and first bushing 76, respectively. The reduced diameter clamping portion 144 is therefore mountable to image modifying devices of reduced diameter. Thus, the clamping device 142 enables the quick and accurate connection of image modifying devices having substantially different diameters along a common optical axis. Although the locking levers 44 are shown on the same side of the clamping device 140, one of the locking levers 44 may be located on the opposite side of the clamping device.

Figure 10:
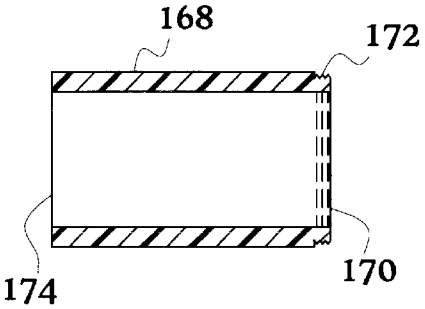
FIG. 10 is a cross sectional view of a camera-mount bushing.
Figure 11:
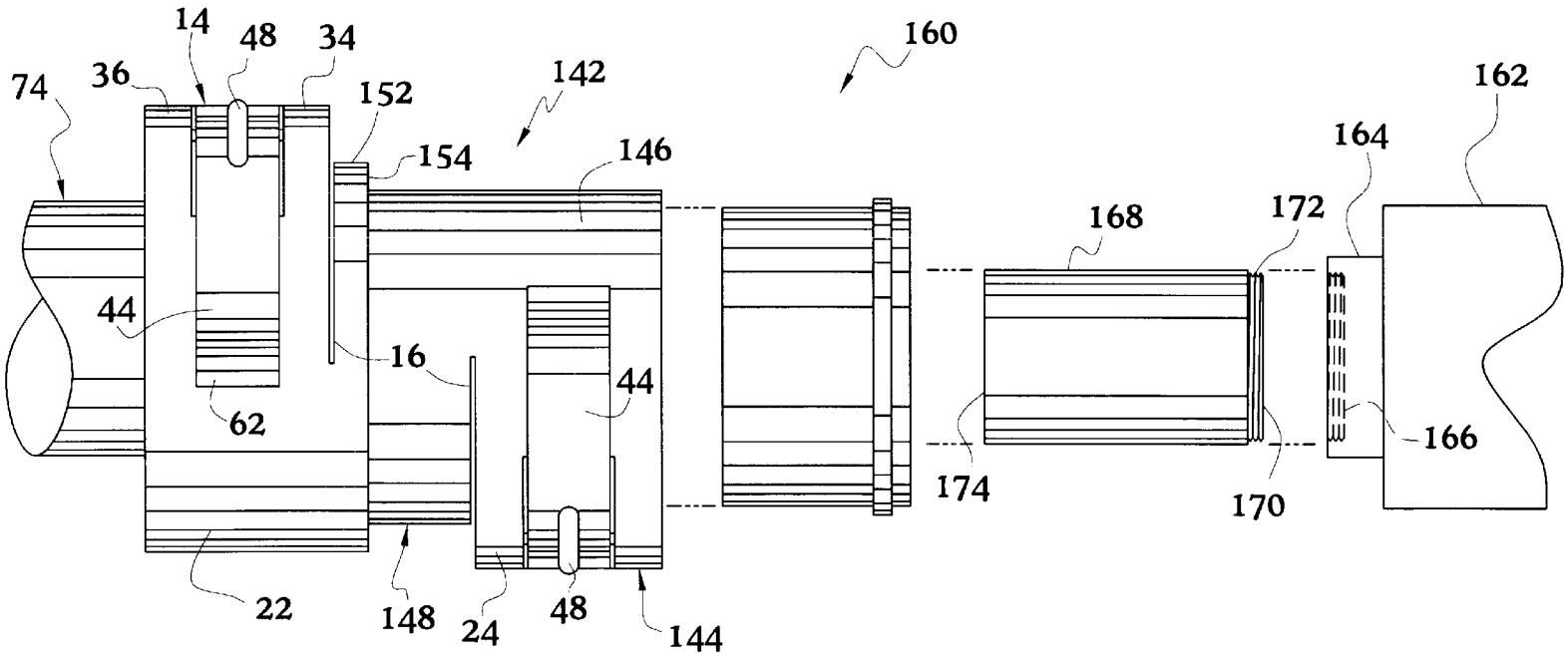
FIG. 11 is a side elevational view of an optical viewing assembly incorporating the camera mount bushing of FIG. 10.

Referring now to FIGS. 10 and 11, an optical viewing assembly 160 incorporating a clamping device 142 according to a third embodiment of the invention is illustrated, wherein like parts in the previous embodiments are represented by like numerals. The clamping device 142 is connected between a first image modifying device 74, such as a night vision monocular, day scope, and so on, and a second image modifying device, such as a digital video camera or other recording device 162. The recording device 162 includes a well-known objective lens assembly 164 with internal threads 166 (shown in hidden line) that normally engage the external threads of a filter assembly (not shown). A hollow mounting tube 168 has a forward end 170 with external threads 172 that engage the internal threads 166 of the recording device 162 and a rearward end 174 that is received within the bushing 158 and clamping portion 144. With this arrangement, the objective lens assembly 164 of the recording device 162 can be quickly connected to the first image modifying device 74 in optical alignment therewith and quickly disconnected therefrom. The mounting tube 168 is preferably constructed of an acetal resin material such as Delrin™, or other plastic material. Alternatively, the mounting tube 168 may be constructed of metal, such as aluminum. With the above-described arrangement, the image viewed through the first image modifying device 74 can be recorded by the recording device 162 to thereby record events in real time as they occur. This is especially advantageous in low light or night-time conditions and eliminates the need to purchase special night vision recording equipment.

In each of the above embodiments, and by way of example, when the second image modifying device is a scope and the first image modifying device has an adjustable focus, it may be desirable to adjust the focus of the first image modifying device to obtain the best image quality through both devices after they are connected together. In some image modifying device combinations, such as the combination of a night vision monocular mounted behind a day scope, it has been found that focusing the night vision monocular on the reticle or cross hairs of the day scope provides the best overall image quality. When the clamping device is connected between the image modifying devices, the focusing ring 92 of one or both devices is normally locked against movement so that inadvertent jaring or other forces do not change the focus adjustment. When it becomes necessary to adjust the focus of the image modifying device, such as when the image modifying devices are first connected together, the clamping portion 14, 82 or 144 may be loosened as previously described. The clamping device and/or the image modifying device is then rotated with the image modifying device still located within the split collar 22 or 146 to rotate the focusing ring 92 with respect to the housing 88. Once the proper focus adjustment has been achieved, the clamping portion can then be moved to the clamping position to thereby lock the image modifying device to the clamping device and the focusing ring 92 with respect to the housing 88.

In each of the above embodiments, it is to be understood that the invention is not limited to the particular shape and configuration of the first and second bushings as shown and described, since a wide variety of image modifying devices with a wide variety of shapes may be accommodated by providing different bushings that complement their shapes. The bushings may even be offered in kit form for a particular line or lines of image modifying devices. By way of example, the kit may include a clamping device together with a first set of bushings of different configuration for accommodating the most popular night vision monoculars, and a second set of bushings for accommodating the most popular firearm-mounted day scopes.

With the clamping device in each of the above embodiments, it is now possible to quickly mount a night vision monocular to the ocular or objective ends of a firearm day scope without the necessity of resighting or re-zeroing the day scope, as in the prior art systems which require the removal of the day scope prior to mounting the monocular. Moreover, the clamping device and night vision monocular or miniature infrared camera can advantageously be used with firearms that include both an infrared laser aiming device and a day scope. With the night vision monocular mounted to the day scope in accordance with the present invention, the infrared laser aiming device can be quickly sighted in by a single user by adjusting the windage and elevation mechanisms associated with the laser until an infrared laser dot projecting on a distant target is aligned with the cross hairs of the day scope. This is possible since the clamping device ensures that an optical axis of the night vision monocular or infrared camera will be coincident with an optical axis of the day scope. Thus, it is only necessary to look through the monocular or camera to view both the cross hairs of the day scope and the projected infrared laser dot from the laser sight at the distant target. The clamping device of the present invention when used in conjunction with image modifying devices thus eliminates the labor-intensive and time consuming task of sighting in aiming devices such as day scopes and laser aiming devices.

Although the split collar and sleeve are shown in the above-described embodiments as being generally cylindrical, they may have different cross sectional shapes.

Figure 12:
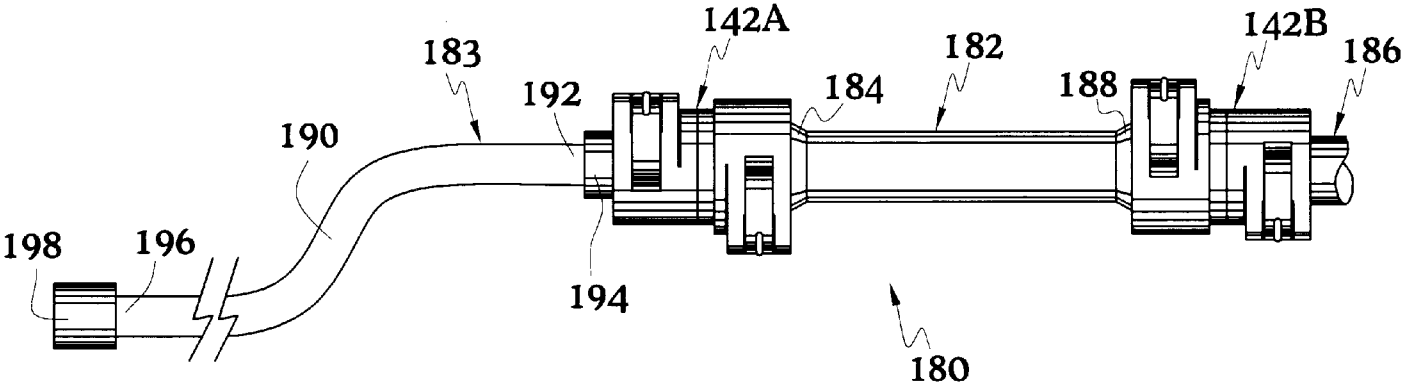
FIG. 12 is a side elevational view of an optical viewing assembly according to the invention incorporating a pair of fourth embodiment clamping devices and a fiber optic viewer.

Turning now to FIG. 12, an optical viewing assembly 180 according to a further embodiment of the invention is illustrated, wherein like parts in the previous embodiments are represented by like numerals. The optical viewing assembly 180 includes a day scope 182 of conventional construction, a first image modifying device 183 connected at the ocular or rearward end 184 of the day scope 182 through a first clamping device 142A, and a second image modifying device 186, such as a night vision monocular, connected to an objective or forward end 188 of the day scope through a second clamping device 142B. The day scope 182 may be a firearm scope, spotting scope, and so on. The first and second clamping devices 142A and 142B may be identical in construction, or may be a combination of different clamping devices as previously described, depending on the type of image modifying devices to be mounted together. Other clamping devices may alternatively used, depending on their suitability for the intended purposes as disclosed herein.

The first image modifying device 183 is in the form of a fiber optic viewer which includes a fiber bundle 190 having a first end 192 connected to a first lens assembly 194 and a second end 196 connected to a second lens assembly 198. As used throughout the specification, the term "lens assembly" may refer to one or more lenses. The fiber optic bundle 190, by way of example, may be constructed of 40,000 optical fibers with each fiber being approximately 0.0025 inch thick. Preferably, each optical fiber is constructed of high quality optical glass. The ends of the strands may be arranged in a predetermined order and bonded permanently together. Each end of the fiber optic bundle 190 is optically polished to form a smooth, planar surface. Any image that is focused on the first end 192 by the first lens assembly 194 travels down the fiber optic bundle 190 and is incident at the second end 196. The image at the second end can then be magnified by the second lens assembly for viewing by a user of the assembly 180. Further details of a suitable fiber optic viewer can be found in U.S. Pat. No. 5,103,567 issued to Loving, and U.S. Pat. No. 5,054,225 issued to Giuffre et al., the disclosures of which are hereby incorporated by reference.

The first lens assembly may be positioned in an elastomeric bushing or the like, as previously described, for removably mounting the first lens assembly to the clamping device. The second lens assembly 198 may be removably mounted on a helmet 216 (FIG. 14) adjacent a user's eye so that the user 216 may see the image incident at the ocular end 184 of the day scope 182 without the necessity of aligning the user's line of sight with the scope line of sight. One or both of the lens assemblies may include suitable focus adjustment mechanisms.

The optical viewing assembly 180 is particularly useful in low light conditions so that enlisted personnel or others may safely view the target around corners or other obstacles. The clamping devices 142A and 142B are particularly advantageous since the night vision monocular 186 and fiber optic viewer 183 can be quickly connected to and disconnected from any scope that may already be present on the firearm without modification of the scope and with the assurance that the system will be optically aligned.

When the assembly 180 is to be used in daylight conditions, the night vision monocular 186 may be quickly dismounted by loosening the second clamping device 142B, as previously described, and removing both the clamping device and the monocular from the scope 182. Alternatively, it may be desirous to use the night vision monocular 186 without the scope 182. In this instance, the first clamping device 142A is released from the scope 182 and the monocular 186 is mounted to the first clamping device with a suitable bushing to thereby connect the monocular 186 to the fiber optic viewer 183.

In a further embodiment, the night vision monocular 186 may be connected to the ocular end of the scope 182 and the fiber optic viewer 183 may be connected to a rear end of the night vision monocular.

Figure 13:
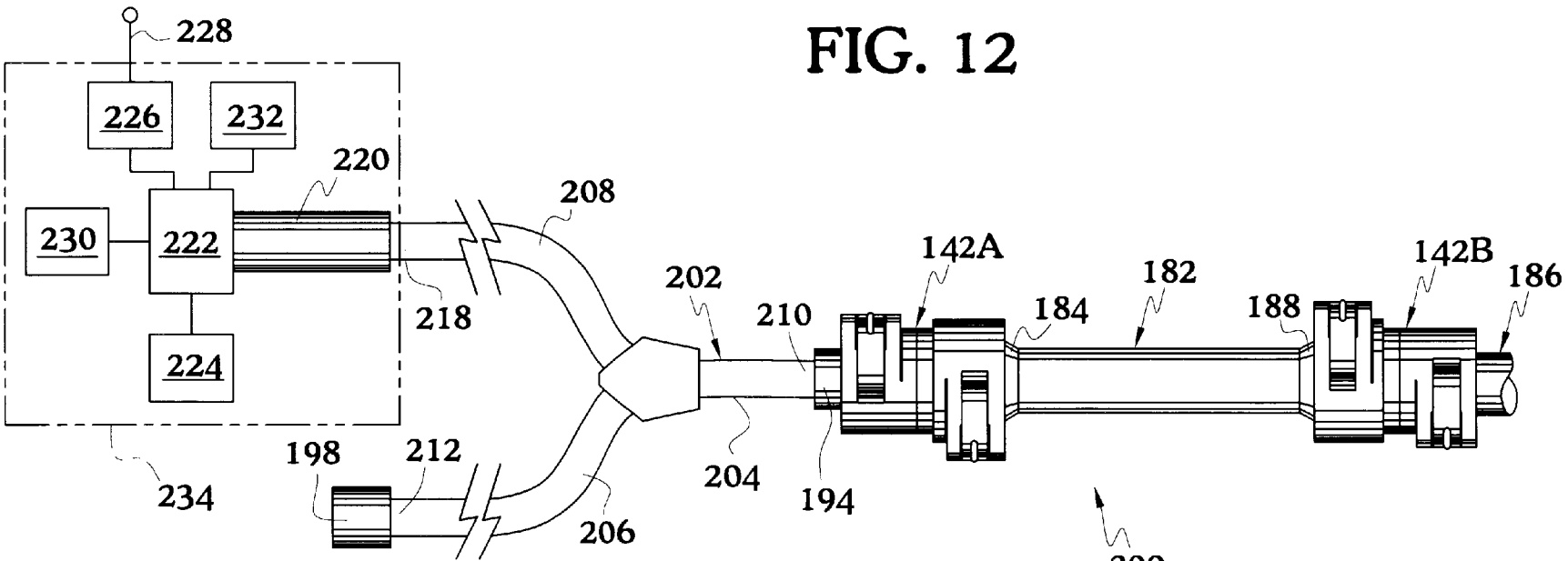
FIG. 13 is a side elevational view of an optical viewing assembly according to the invention incorporating a pair of fourth embodiment clamping devices and a segmented fiber optic viewer.
Figure 14:
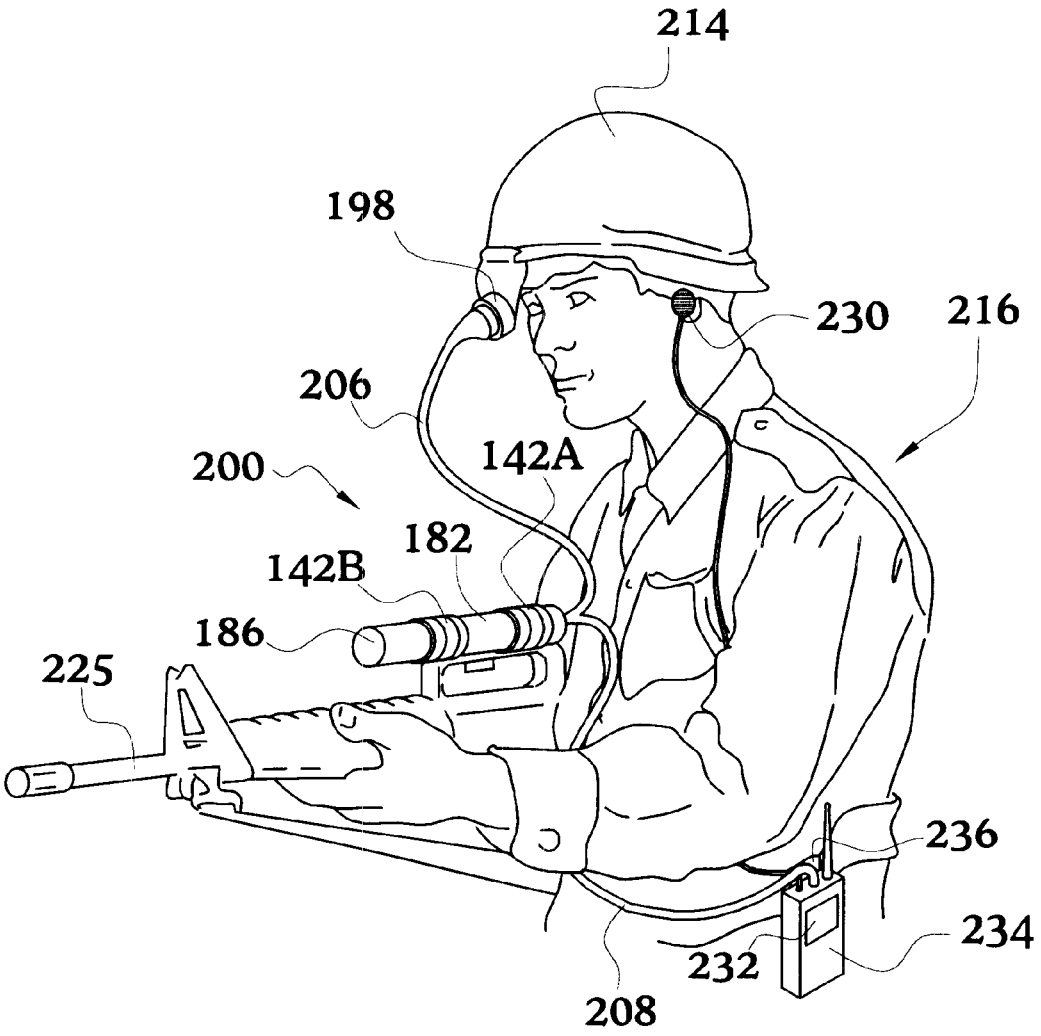
FIG. 14 illustrates the optical viewing assembly of FIG. 13 in use.

With reference now to FIGS. 13 and 14, an optical viewing assembly 200 according to a further embodiment of the present invention is illustrated, wherein like parts in the previous embodiments are represented by like numerals. The optical viewing assembly 200 includes a fiber optic viewer 202 having a fiber optic bundle 204 that is divided into first and second fiber optic segments 206 and 208, respectively. A forward end 210 of the fiber optic bundle 204 is connected to a first lens assembly 194, which is in turn connected to the ocular end 184 of the scope 182 through the first clamping device 142A. A rearward end 212 of the first fiber optic segment 206 is connected to a second lens assembly 198, which may in turn be mounted to the helmet 214 adjacent the eye of a user 216. A rearward end 218 of the second fiber optic segment 208 is connected to a video camera 220, which is preferably of the solid state digital type. The individual optical fibers of the bundle 204 are preferably arranged and separated so that approximately the same image is coincident at both the video camera and the user's eye. The video camera 220 is connected to a processor 222, which may be in the form of a microprocessor or other circuitry, so that video or other image data from the video camera can be received and processed during operation. Although the fiber optic viewer 202 is shown with two segments, it is to be understood that more segments may be provided for connection to further image modifying devices.

The fiber optic viewer 202 is flexible so that relative movement can occur between the firearm 225, user's head, and video camera without affecting the view through the scope 182. The fiber optic viewer 202 is lightweight and low in profile, an especially important feature when used in combat or other life threatening situations. Although the resolution in each fiber optic segment 206, 208 is less than the overall resolution of a non-segmented fiber optic viewer, the intensity of light will be approximately the same. Thus, where the assembly 200 is used in low light conditions, the image intensity at the ends 212, 214 of the segments 206, 208 should not be compromised.

A microphone 224 or other data input device may also be connected to the processor for inputting audio or other information. The processor 222 is in turn connected to a transceiver 226 for transmitting the video and audio data to a base station 240 (FIG. 15), as well as receiving feedback data from the base location, as will be described in greater detail below. Where no feedback from the base station is necessary or desirous, the transceiver 226 may be replaced with a transmitter.

The transceiver 226 includes an antenna 228 for transmitting and receiving data via a wireless connection, but may alternatively transmit and receive data via hard wire, such as coaxial cable. In a preferred arrangement, the transceiver comprises a cellular telephone, but may alternatively comprise radio transmission and reception circuitry. An earphone 230 and a video display 232 may also be connected to the processor for audibly and visually discerning the feedback data transmitted from the base station 240. In some instances, it may be desirous to encode the data prior to transmission and decode the data after transmission for security reasons. The encoding/decoding can be accomplished using well-known techniques in either the processor or transceiver. A housing 234 (shown in phantom line in FIG. 13) may be provided to contain the video camera 220, the microphone 224, the processor 222, the transceiver 226, a battery (not shown) or other power source, and other related components. The housing 234 may include a clip 236 for securing the components to a shirt, belt, back pack, or any other convenient location on a person.

As in the previous embodiment, when the assembly 200 is to be used in daylight conditions, the night vision monocular 186 may be quickly dismounted by loosening the second clamping device 142B, as previously described, and removing both the clamping device and the monocular from the scope 182. Alternatively, it may be desirous to use the night vision monocular 186 without the scope 182. In this instance, the first clamping device 142A is released from the scope 182 and the monocular 186 is mounted to the first clamping device with a suitable bushing to thereby connect the monocular 186 to the fiber optic viewer 202.

In a further embodiment, the night vision monocular 186 may be connected to the ocular end of the scope 182 and the fiber optic viewer 202 may be connected to a rear end of the night vision monocular.

Figure 15:
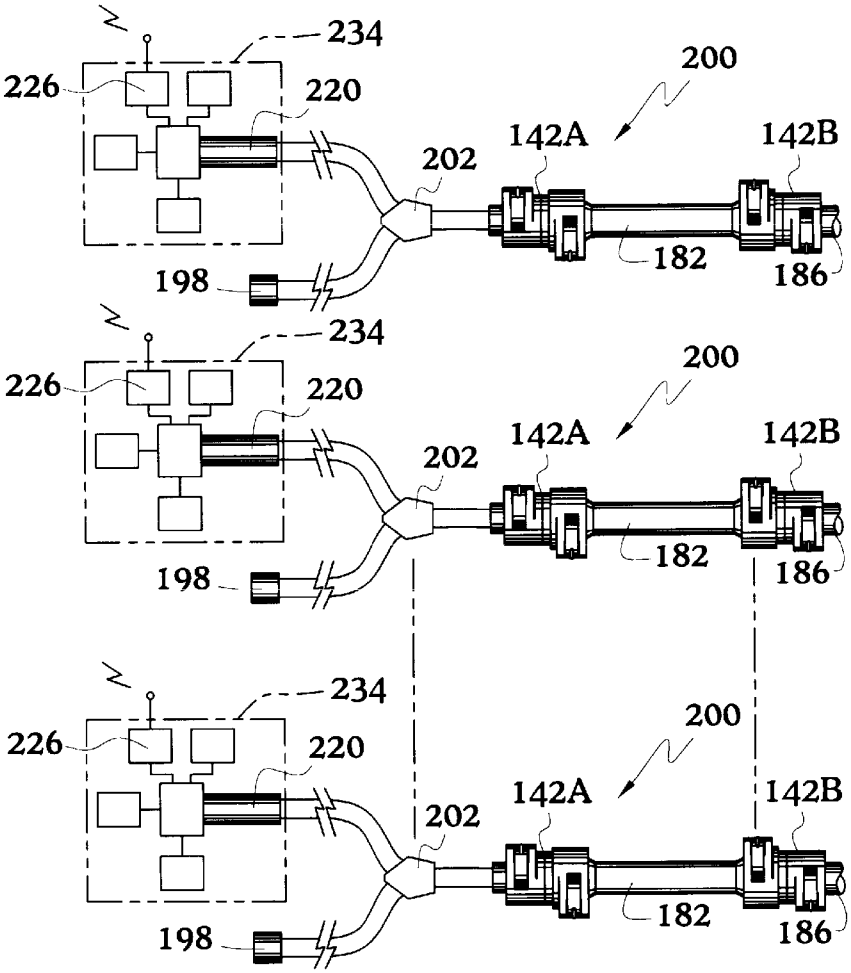
FIG. 15 is a schematic diagram of an optical viewing system according to the invention incorporating a plurality of optical viewing assemblies and a base station with a communication link between the assemblies.
Figure 15:
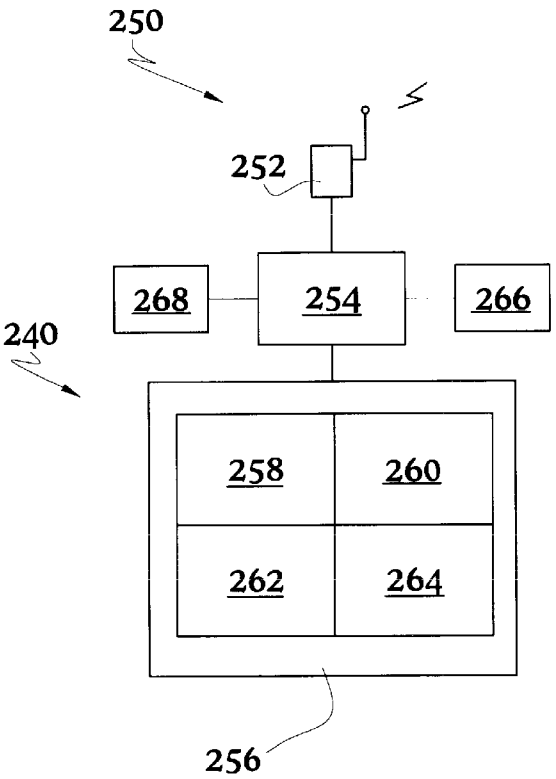

With reference now to FIG. 15, schematic diagram of an optical viewing system 250 is illustrated, wherein like parts in the previous embodiments are represented by like numerals. The optical viewing system 250 includes a plurality of remote optical viewing assemblies 200 that are in communication with the base station 240 through wireless data links, as previously described. The base station 240 includes a transceiver 252 that receives the signals from each assembly 200. Where no feedback from the base station is necessary or desirous, the transceiver 252 may be replaced with a receiver. The transceiver 252 is connected to a processor 254, such as a microprocessor or other circuitry, for processing the received data and performing any decoding routines if needed. A display 256 is connected to the processor for displaying one or more transmitted images. Preferably, the transmitted images from different optical viewing assemblies 200 are simultaneously displayed, as shown by images 258, 260, 262, and 264 on the display 256. Alternatively, a separate display may be provided for each viewing assembly 200. Signals received by the transceiver may be demultiplexed in order to separate the signals from the different assemblies 200. This may be accomplished by assigning a unique identifier or encoding routine to each viewing assembly 200 that is transmitted together with the data stream. In an alternate arrangement, a separate receiver or transceiver 252 may be provided for each viewing assembly 200, with one or more of the transceivers being connected to the processor 254 for displaying the transmitted information on the display 256. A microphone or other data input device 266 may also be connected to the processor 254 with suitable switching circuitry for transmitting audio instructions or other information to one or more of the assemblies 200, and thus to the person or persons using the assemblies. A speaker 268 may be connected to the processor 254 for communicating transmitted audio data from one or more of the assemblies 200.

In use, the image received through the scope 182 is transmitted simultaneously to the video camera 220 and to the eye of a user 216 via the fiber optic viewer 202. The video camera 220 converts the image into a digital signal, which in turn may be encoded by the processor for transmission to the base station 240. Audio or other data may also be encoded and transmitted simultaneously with the video data. At the base station 240, the encoded signals are decoded in the processor and transmitted to the display 256 so that persons located at the base station can view images and other data and hear sounds at the remote location. In this manner, especially when more than one assembly 200 is in use, one or more persons at the base station can make informed decisions for directing individual users 216 at remote locations through feedback data transmitted to the assemblies 200. The image and sound data received by the base station may be recorded for later recall. This feature is especially important during training operations, critiques or inquiries where the user or other individuals can review the user's performance and determine whether that performance was in accordance with instructions, previous training or other parameters.

While the invention has been taught with specific reference to the above-described embodiments, those skilled in the art will recognize that changes can be made in form and detail without departing from the spirit and the scope of the invention. Although the clamping devices described above refer to connecting two or more image modifying devices together, it is to be understood that the clamping devices can be used for different purposes. For example, the clamping devices can be used to mount lasers and lighting devices onto fixed objects, for attaching sound suppressors to firearm barrels, or where two objects need to be quickly coupled together or decoupled. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A clamping device for releasably coupling two objects together, the clamping device comprising:

a hollow sleeve having a first end and a second end;

a first clamping portion integrally connected to the hollow sleeve first end;

a second clamping portion integrally connected to the hollow sleeve second end;

each of the first and second clamping portions having a split collar that is adapted to receive one of the objects, each collar having a pair of clamping legs with a generally longitudinally extending space therebetween, at least one of the clamping legs being separated from the sleeve by a slot that extends at least part way around a perimeter of the sleeve in a direction generally transverse to the space to thereby permit movement of at least one of the clamping legs toward and away from the other of the clamping legs, wherein movement of the at least one clamping leg toward the other clamping leg reduces a cross dimension of the split collar to thereby clamp one of the objects therein, and wherein movement of the at least one clamping leg away from the other clamping leg increases a cross dimension of the split vollar to thereby release a clamped object.

2. A clamping device according to claim 1, wherein the first and second clamping portions are coaxial.

3. A clamping device according to claim 1 and further in combination with the two objects, with one of the objects comprising a first image modifying device mounted in the first clamping portion and the other of the objects comprising a second image modifying device mounted in the second clamping portion.

4. A combination according to claim 3, wherein the first and second clamping portions are coaxial such that the image modifying devices extend along a common optical axis.

5. A combination according to claim 3, and further comprising a bushing located between each image modifying device and the respective clamping portion.

6. A combination according to claim 5, wherein the bushings are constructed of an elastomeric material.

7. A combination according to claim 3, wherein the first image modifying device comprises a scope, and the second image modifying device comprises a fiber optic viewer with first and second ends, the first end of the fiber optic viewer being mounted to an ocular end of the scope through the clamping device for transmitting an image incident at the ocular end to the second end of the fiber optic viewer.

8. A combination according to claim 3, wherein the first image modifying device comprises a scope, and the second image modifying device comprises a fiber optic viewer, the fiber optic viewer comprising a fiber optic bundle that is divided into at least first and second fiber optic segments, a forward end of the fiber optic bundle being connected to an ocular end of the scope through the clamping device for transmitting an image incident at the ocular end to a rearward end of each fiber optic segment.

9. A combination according to claim 8, and further comprising a third image modifying device mounted to the rearward end of one of the first and second fiber optic segments for transforming the incident image into electrical signals.

10. A combination according to claim 9, wherein a lens assembly is mounted to the rearward end of the other of the first and second segments for simultaneously viewing the incident image by a user.

11. A combination according to claim 10, and further comprising a transmitter operably associated with the third image modifying device for transmitting the electrical signals to a remote location.

12. A combination according to claim 11, and further comprising a receiver at the remote location for receiving the transmitted electrical signals.

13. A combination according to claim 11, and further comprising a display operably associated with the receiver for viewing the incident image at the remote location.

14. A combination according to claim 13, and further comprising a night vision device mounted to an objective end of the scope.

15. A combination according to claim 9, wherein the third image modifying device comprises a video camera.

16. A clamping device for relesably coupling two objects together, the clamping device comprising:

a hollow sleeve having a first end and a second end;

a first clamping portion integrally connected to the hollow sleeve first end;

a second clamp portion integrally connected to the hollow sleeve second end;

each of the first and second clamping portions having a split collar that is adapted to receive one of the objects, each collar having a pair of clamping legs with a generally longitudinally extending space therebetween, at least one of the clamping legs being separated from the sleeve by a slot that extends at least part way around a perimeter of the sleeve in a direction generally transverse to the space to thereby permit movement of at least one of the clamping legs toward and away from the other of the clamping legs, wherein movement of the at least one clamping leg toward the other clamping leg reduces a cross dimension of the split collar to thereby clamp one of the objects therein, and wherein movement of the at least one clamping leg away from the other clamping leg increases a cross dimension of the split collar to thereby release a clamped object;

at least one of the clamping portions further comprising:

a locking lever pivotally connected to one of the camping legs at a first pivot joint; and a link arm having a first end pivotally connected to the other clamping leg at a second pivot joint and a second end pivotally connected to the locking lever at a third pivot joint;

wherein rotation of the locking lever in one direction causes the clamping legs to move toward each other and rotation of the locking lever in an opposite direction causes the clamping legs to move away from each other.

17. A clamping device according to claim 16, wherein the third pivot joint is moved to an over center position with respect to an imaginary line extending through the first and second pivot joints when the locking lever is rotated in the one direction to thereby retain the locking lever in a locked position.

18. A clamping device for releasably coupling two objects together, the clamping device comprising:

a hollow sleeve having a first end and a second end;

a first clamping portion integrally connected to the hollow sleeve first end;

a second clamping portion integrally connected to the hollow sleeve second end;

each of the first and second clamping portions having a split collar that is adapted to receive one of the objects, each collar having a pair of clamping legs with a generally longitudinally extending space there between at least one of the clamping legs being separated from the sleeve by a slot that extends at least part way around a perimeter of the sleeve in a direction generally transverse to the space to thereby permit movement of at least one of the clamping legs toward and away from the other of the clamping legs, wherein movement of the at least one clamping leg toward the other clamping leg reduces a cross dimension of the spilt collar to thereby clamp one of the objects therein, and wherein movement of the at least one clamping leg away from the other clamping leg increases a cross dimension of the split collar to thereby release a clamped object;

each clamping portion further comprising:

a locking lever pivotally connected to one of the clamping legs at a first pivot joint; and a link arm having a first end pivotally connected to the other clamping leg at a second pivot joint and a second end pivotally connected to the locking lever at a third pivot joint;

wherein rotation of the locking lever in one direction causes the clamping legs to move toward each other and rotation of the locking lever in an opposite direction causes the clamping legs to move away from each other.

19. A clamping device according to claim 18, wherein the third pivot joint is moved to an over center position with respect to an imaginary line extending through the first and second pivot joints when the locking lever is rotated in the one direction to thereby retain the locking lever in a locked position.

20. A clamping device according to claim 18, wherein the locking levers of the first and second clamping portions extend in similar directions.

21. A clamping device according to claim 20, wherein the locking levers are located on similar sides of the clamping portions.

22. A clamping device according to claim 18, wherein the locking levers of the first and second clamping portions extend in opposite directions.

23. A clamping device according to claim 22, wherein the locking levers are located on similar sides of the clamping portions.

* * * * *

UNITED STATES PATENT AND TRADEMARK OFFICE

CERTIFICATE OF CORRECTION

PATENT NO. : 6,449,419 B1
DATED : September 10, 2002
INVENTOR(S) : Richard Brough et al.

It is certified that error appears in the above-identified patent and that said Letters Patent is hereby corrected as shown below:

Column 13,
Line 19, replace “camping”, with -- clamping --.

Signed and Sealed this

Fourth Day of March, 2003

JAMES E. ROGAN
*Director of the United States Patent and Trademark Office*